US005431985A

United States Patent [19]

Schilling

[11] Patent Number: 5,431,985

[45] Date of Patent: Jul. 11, 1995

[54] LOW-DENSITY ELEMENT MADE OF CORRUGATED MATERIAL

[75] Inventor: Frank Schilling, Alvesloe, Germany

[73] Assignee: Edm. Romberg & Sohn (GmbH & Co.) KG, Germany

[21] Appl. No.: 75,573

[22] PCT Filed: Dec. 3, 1991

[86] PCT No.: PCT/EP91/02303

§ 371 Date: Jul. 27, 1993

§ 102(e) Date: Jul. 27, 1993

[87] PCT Pub. No.: WO92/09501

PCT Pub. Date: Jun. 11, 1992

[51] Int. Cl.[6] ..... B32B 3/28; B65D 81/02

[52] U.S. Cl. ..... 428/182; 428/184; 428/186; 206/584; 206/814; 493/967

[58] Field of Search ..... 428/182, 184, 2, 72, 428/101, 186, 130, 192, 212, 213, 537.5; 493/967; 206/584, 814; 220/448

[56] References Cited

U.S. PATENT DOCUMENTS

| | | | |
|---|---|---|---|
| 1,333,884 | 3/1920 | Usinger | 428/184 |
| 1,619,011 | 3/1927 | Agar | 428/184 |
| 1,902,312 | 3/1933 | Rous | 428/184 |
| 2,575,898 | 11/1951 | Tadinger | 428/184 |
| 2,947,459 | 8/1960 | Pregent | 229/14 |
| 3,042,278 | 7/1962 | McCullough | 428/182 |
| 4,771,893 | 9/1988 | Liebel | 206/586 |
| 4,882,893 | 11/1989 | Spencer et al. | 53/449 |

FOREIGN PATENT DOCUMENTS

| | | |
|---|---|---|
| 336107 | 10/1989 | European Pat. Off. . |
| 393804 | 10/1990 | European Pat. Off. . |
| 9006005.9 | 9/1990 | Germany . |
| 663888 | 12/1951 | United Kingdom . |

*Primary Examiner*—Donald J. Loney

*Attorney, Agent, or Firm*—Fay, Sharpe, Beall, Fagan, Minnich & McKee

[57] ABSTRACT

The present invention relates to a low-density material element for use as protective packaging. The material element consists of a multi-layered body of a corrugated material which is lined on one of its sides. Thus the neighboring corrugated layers lie adjacent one another with a common lining layer without interlocking with one another and without being compressed. The multi-layer body has an extension length (L, E) which is in a direction perpendicular to both the corrugation extension direction and the layering direction. The multi-layer body is characterized in that it is held together with a singly positioned fixation. This singly positioned fixation functions to allow neighboring corrugated layers to lie loosely adjacent one another without being compressed. Furthermore, the singly positioned fixation allows the corrugated layers to be slidable relative to one another in a direction perpendicular to the corrugation extension (S) on being bent in a plane towards the body material.

66 Claims, 4 Drawing Sheets

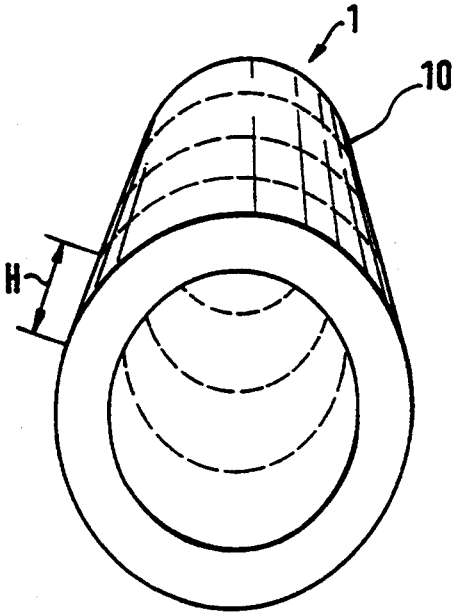
FIG.7a
FIG.7b
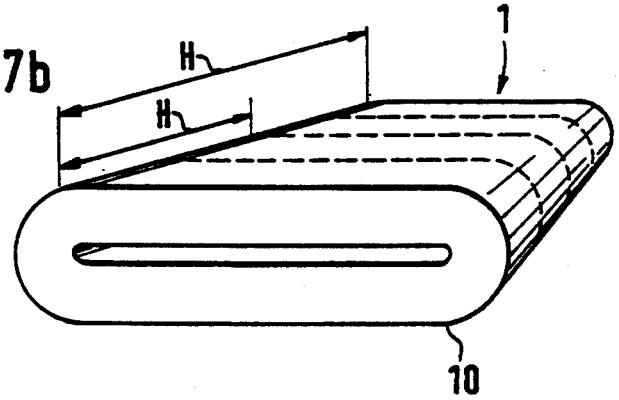
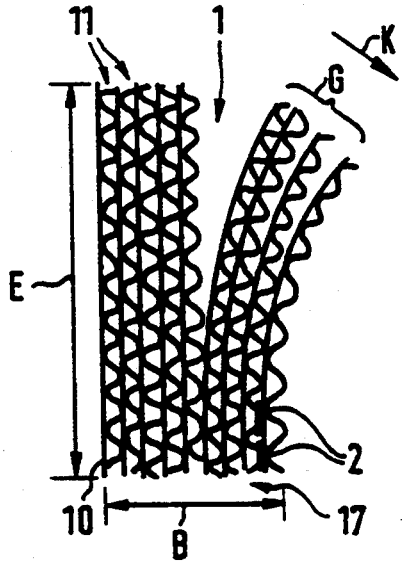
FIG.8

LOW-DENSITY ELEMENT MADE OF CORRUGATED MATERIAL

BACKGROUND OF THE INVENTION

The invention concerns a low-density material element for use as protective packaging of packagable articles in a packing container, consisting of a multilayer body comprising a corrugated material, lined on one side, with the corrugations of the layers extending in the same direction, and in which in the direction of layering, the neighbouring corrugated layers lie adjacent one another with a common lining layer without interlocking with one another and without being compressed, the extention length of said body, in a direction perpendicular to both the corrugation extension and the layering direction, being several times its layering thickness.

DESCRIPTION OF RELATED ART

The use of corrugated material pieces or corrugated material bodies as packaging is well known. Such elements have a fixed form. They are either portions cut from a corrugated material body or in the form of a rolled material that contains no hollow space. A desirable flexible adaptation of its shape to that of articles to be packaged in containers is not or, on applying a considerable pressure to the bodies surface, only slightly possible, wherein in the latter case, the corrugated material layers become compressed and also destroyed. Apart from these, packaging materials made of plastic are also known, which are expensive to manufacture, have high raw material costs, are harmful to the environment and are connected with disposal problems.

SUMMARY OF THE INVENTION

The task of the invention is to provide elements of the kind described above which are flexible to such an extent that they can be formed into a wide variety of concave or groove shaped cross-sectional contours, such that they can serve as a complete substite for plastic elements.

This object is achieved in connection with the features of the material element mentioned above, by the fact that the material body is held together with a singly positioned fixation such that the neighbouring corrugated layers lie loosely adjacent one another without being compressed and are slidable relative to one another in a direction perpendicular to the corrugation extension, on being bent in a plane towards the body interior. The material elements according to the invention can be produced in large quantities and very cheaply, since in mass production they can be cut from half-finished bodies that, in particular, are made entirely of recycled waste paper. They can be produced in a wide variety of dimensions. Due to their flexibility, they can be universally employed as protective packaging against knocks for all kinds of articles. In doing this, they form flexible nests or cushions that mould to edges, corners, projections and the like, wherein they take on e.g. an L, U, T, I, S or P shaped cross-sectional profile. A fundamental advantage attached to this is that the corrugated layers are neither squashed nor destroyed on forming a profile, so that the cushioning properties of the corrugated material structure can be optimally exploited and the material element can also be reused, in which case it can take on other cross-sectional forms.

BRIEF DESCRIPTION OF THE DRAWINGS

Particularly useful and advantageous embodiment forms and possibilities of the invention are defined in the subclaims and will be described in greater detail in the following description with reference to the embodiments represented in the schematic drawings. There is shown in FIGS. 1 and 2 axonometric views of material elements according to the invention, which have formed contours extending with an S-, L- or U-like shaped cross-sectional profile, FIGS. 3 and 4 a cross-sectional view of flexible material elements according to the invention that can be formed into a wide variety of cross-sectional shapes on application of pressure to its external surfaces, FIGS. 5A to 6B a cross-sectional view of material elements according to the invention with a stiff or rigid layer defining the bent form, disposed on the element, FIGS. 7A and 7B a material element according to the invention that is divisible into further elements according to the invention, and FIG. 8 a cross-sectional view of a further material element according to the invention.

DESCRIPTION OF THE PREFERRED EMBODIMENT

Figure 1:
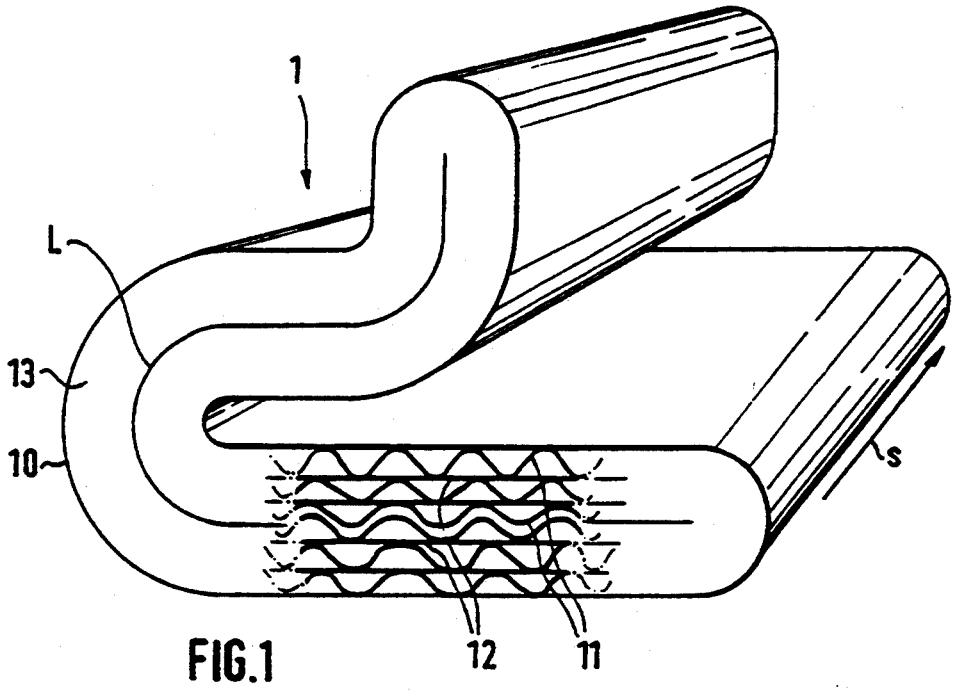
Figure 2:
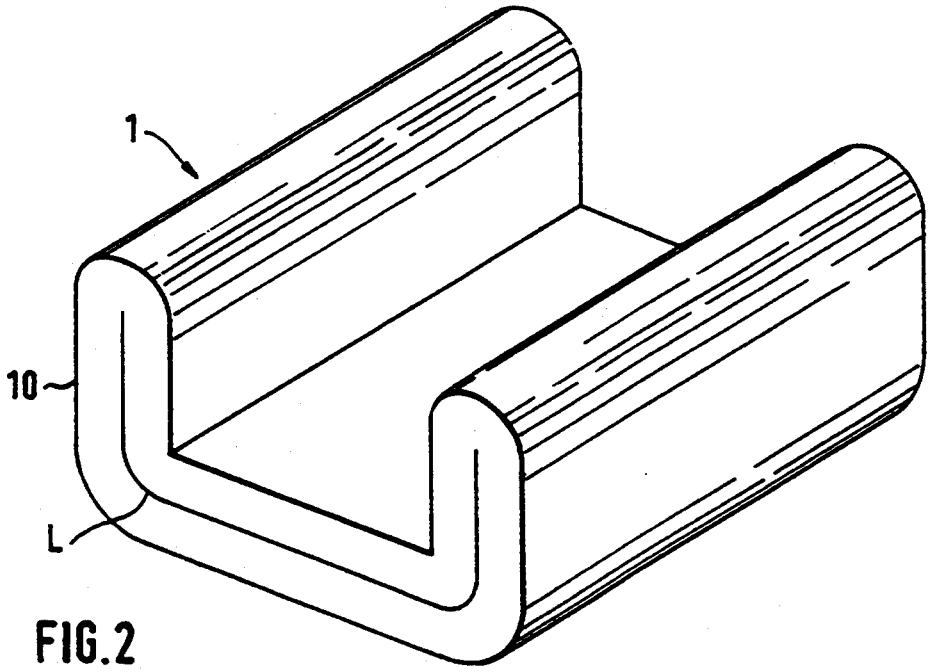

The material elements 1 in FIGS. 1 and 2 are formed elements which, starting from closed ring bodies 10 which in turn constitute material bodies, are formed into the illustrated cross-sectional profile forms. These forms arise from the fact that the elements are laid against the surfaces of the packaged articles, which are not shown. In doing this, the material element fills hollow spaces in a packaged article or between said article and the walls of a packing container (not shown). Thus, it should be noted that the material elements according to FIGS. 1 and 2 are flexible per se and their cross-sectional forms can be altered.

The ring body 10 forming the material elements 1 according to FIGS. 1 and 2 comprises three flexible corrugated layers 11 that are lined on one side, wherein neighbouring corrugated layers 11 lie loosely adjacent one another with a common lining layer 12 without interlocking with one another and without compression. The aligned corrugations extend in a direction S perpendicular to the cross-sectional profile. In FIG. 1 the ring body's 10 corrugated layers 11 are shown only in section, while the rest of the material element is schematically represented in its contour, as is also the case in FIG. 2. In this respect, the line marked L indicates that the ring body's 10 material ring 13 lies collapsed together with no space in the middle.

Figure 3:
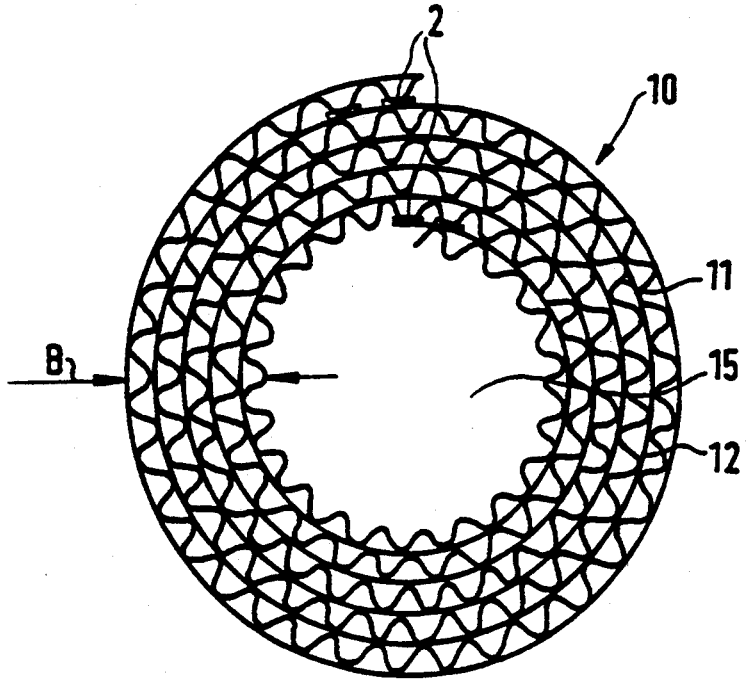
Figure 4:
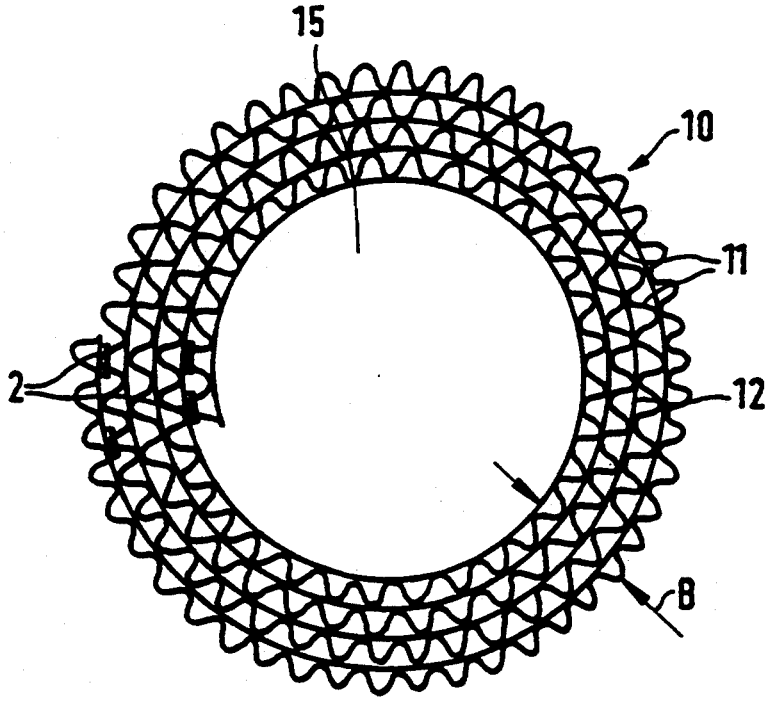

Ring bodies 10 with circular cross-sections as provided for the formation of the material elements in FIGS. 1 and 2, are shown in more detail in FIGS. 3 and 4. The length of the inner circumference of the ring is a multiple of the ring width B. It is evident that the circular ring bodies 10 forming the material elements 1 represented in FIGS. 1 and 2 have a substantially larger ring circumference compared to the ring width B than the ring bodies 10 shown in FIGS. 3 and 4.

Figure 5A:
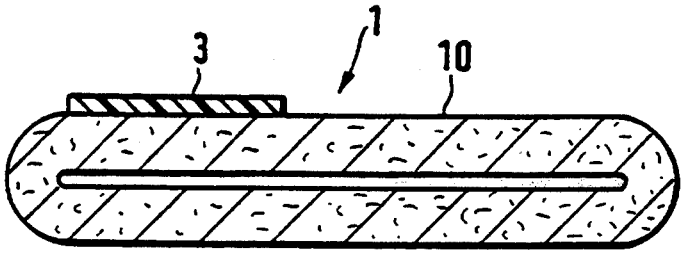
Figure 6A:
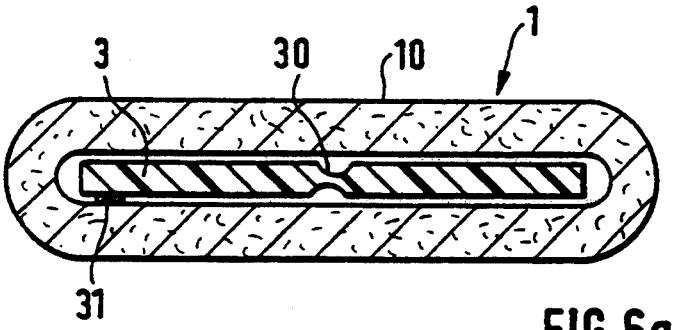

The ring bodies 10, according to FIGS. 3 and 4 comprise four or five corrugated layers 11 lying adjacent one another, which define the ring width B and which lie with their corrugation extension perpendicular to the direction of the ring circumference. Such a circular ring body 10 is spirally wound from a single corrugated material portion, which is lined on one side and is preferably in the form of rollable corrugated cardboard. Only the roll ends, lying parallel to the corrugation extension, are fixed at the exterior or interior circumference of the ring with a glue or other adhesive join 2. Due to this singly positioned fixation, according to the invention, the neighbouring corrugated layers 11 lie loosely on one another without compression and can slide relative to one another in a direction perpendicular to the corrugation extension direction on being bent in a plane. It is essential that the exterior and interior corrugated layers of the ring are fixed with regard to their circumferences, so that these are determined in advance. Due to the presence of the hollow ring space 15 and the fact that ring layers lie loosely adjacent on another with only one common lining layer 12, the cross-sectional profile of the ring body can be substantially deformed on applying pressure on its exterior circumference. During such a deformation, the corrugated layers do not interlock with one another and are neither squashed nor distroyed. By employing very lightweight corrugated material, in particular one made of recycled waste paper, as is preferably intended for the invention, the material element ring body can take on oval shaped forms due solely to its own dead weight, as is shown in FIGS. 5A, 6A and 7B.

According to FIG. 3, the ring body 10 is wound with an externaly situated lining layer 12. In this way, the ring layers meeting in the ring interior on deformation interlock with the flutes of the innermost ring layers, as is shown in FIG. 1. This interlocking has the effect that the corrugated layers can practically no longer slide relative to one another and the cross-sectional profile is stabilised as a result. But it must be noted that this effect, which may be particularly desired, will only occur when the material element is positioned in its formed state in a cavity to be filled which determines and holds this shape. Once the material element according to the invention is removed from such a cavity, it can be formed anew into cross-sectional shapes corresponding to other cavities or spaces to be filled.

When on moulding the material element, an interior interlocking of the innermost corrugated layers is not desired, there is provided a ring body according to FIG. 4, wound with the lining layer 12 situated towards the ring interior.

It is very significant, that the inventive material elements according to the invention can be used with distinct flat faces and concave bends directed towards the interior of the material element, with the corrugations remaining undamaged, so that it can be laid around edges and sharply bent projections particularly easily.

According to another embodiment of the invention, the ring body comprises concentrically arranged, corrugated layers, forming circular rings, closed per se, being fixed to one another at one position only on the circumference and across the ring thickness with a glue or other adhesive join. In this way can, for example, the profiles shown in FIGS. 1 and 2 also be achieved.

Material element ring bodies according to the invention can also be provided with a singly positioned fixation, which is situated at a position on the circumference but along the ring thickness B. In this way also it is ensured that the layers contained in the ring are able to slide sufficiently relative to one another for flexibly moulding the material element.

As can be seen from FIGS. 5A to 6B, it can be particularly useful to position a flat layer 3 on a portion of the ring body 10 circumference, which is stiff or rigid compared to the bending elasticity of the corrugated layers and which extends at right angles to both the corrugation extension and the cross-sectional profile. Such a layer can be made of hardened adhesive material. It is however, also particularly useful that the flat layer be in the form of a piece of corrugated material with corrugations lying transverse, in particular in a direction perpendicular to the corrugation extension of the material body 10.

Figure 5B:
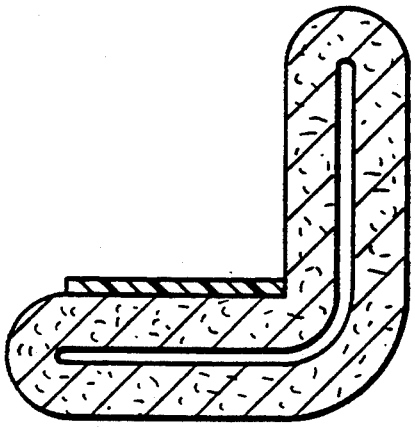
Figure 6B:
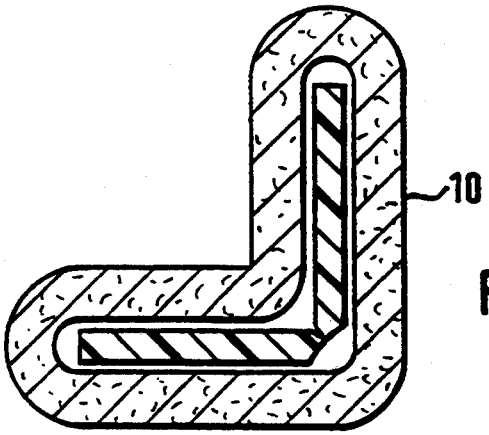

In order to obtain, for example, a predetermined V and/or L shaped profile on formation, the layer 3, according to FIGS. 5A and 5B, is fastened to the exterior circumference of the ring body 10 with a glue or adhesive join, whereas according to FIGS. 6A and 6B, the layer 3 is inserted into the ring interior. In this case, the ring body 10 is arranged around the flat layer 3 loosely (without attachment) or possibly with only a single fixation position 31 (FIG. 6A). In this way, the ring body 10 is held in an oval cross-sectional shape. By means of a line of weakness, for example a notch 30 disposed in the middle of the ring and extending in a direction parallel to the corrugation extension direction of the ring body 10, the material element 1 can easily be bent into the L-shape form represented in FIG. 6B and then returned to its flat form again.

Material element ring bodies 10 are preferably cut from a continuously generated circular ring tubing of wound material, in particular from a tubing of wound rollable corrugated cardboard. In this case, the invention includes in particular, perforation lines, disposed axially spaced along the half-finished tubing and in a line perpendicular to the corrugation extension direction, so that elements of desired ring heights H are easily available, as shown in FIGS. 7A and 7B.

According to FIG. 8, another embodiment of the invention is that a material body 10 of a material element 1 is a layered, parallelepiped shaped body, extending in the direction perpendicular to the corrugation extension, consisting of corrugated layers 11 lined on one side, which form separate material portions. At one of the base sides of the body 17, the layers 11 are fastened to one another with a glue join 2 across the layer thickness B. Due to this singly positioned fastening, on bending K, the layers 11 are maintained slidable in directions perpendicular to the corrugation extension direction so that, depending on its length E, such a material element according to the invention can also be laid into a wide variety of cross-sectional forms. In all cases, the length E extending perpendicular to the corrugation extension direction and to the layering direction, is several times the layering thickness B. Depending on the application, it is possible to bend only a group G of the corrugated layers 11.

I claim:

1. A low-density material element (1) for use as protective packaging of packagable articles in a packing container, consisting of a multilayer body (10) having an extension length (L,E), the body comprising a corrugated material, lined on one side with the corrugations of the layers extending in the same direction, and in the direction of layering the neighbouring corrugated layers lie adjacent one another with a common lining layer (12), without interlocking with one another and without being compressed, said extension length (L,E) of said body, in a direction perpendicular to both the corrugation extension direction and the layering direction, being several times its layering thickness (B), characterized in that the material body (10) is held together with a singly positioned fixation, said singly positioned fixation functioning to allow the neighbouring corrugated layers (11) to lie loosely adjacent one another without being compressed, said singly positioned fixation further allowing the corrugated layers to be slidable relative to one another in a direction perpendicular to the corrugation extension (S) on being bent in a plane towards the body interior.

2. A material element according to claim 1, characterized in that the material body (10) is a parallelepiped shaped layered body, elongated in a direction perpendicular to the corrugation extension direction (S), consisting of material portions separately forming the corrugated layers (11), the layers being fixed with a singly positioned glue or other adhesive join (2) across the layering thickness solely either at one (17) of the base sides of the body or along a join position extending transversely to the corrugation extension direction.

3. A material element according to claim 2, characterized in that the layered body (10) is a piece being separated from a half-finished body which has a plate, wafer, block or tube form, wherein there are preferably provided perforation lines formed on the layers of the half-finished body and superimposed on one another through the layering to form a parting plane for separation.

4. A material element according to claim 1 characterized in that the material body consists of a closed ring body (10) with a circular cross-section, which comprises at least two corrugated layers (11), lying adjacent one another with their corrugation extension (S) perpendicular to the circumferencial direction and determining the ring width with the layering thickness (B), the exterior and interior circumferences of said body being determined and the interior ring circumference being several times the length of the ring width (B).

5. A material element according to claim 4, characterized in that the ring body comprises at least two separate, concentrically arranged circular ring corrugated layers which are fixed together at only one position of the circumference, across the ring width with a glue or other adhesive join.

6. A material element according to claim 4, characterized in that the ring body (10) comprises a rolled body formed by a single material portion, having at least two adjacent spirally wound corrugated layers.

7. A material element according to claim 6, characterized in that only the roll ends lying parallel to the corrugation extension direction are fixed with a glue or other adhesive join at one circumference of the body (10).

8. A material element according to claim 6, characterized in that the spirally wound corrugated layers of the rolled ring body are fixed together at only one position of the circumference, across the ring width with a adhesive join.

9. A material element according to claim 6 characterized in that the material body is a body that is separated from a continuously generated tubing of wound material.

10. A material element according to claim 9 characterized in that the material body is a body that is separated from a continuously generated tubing of wound material with perforation lines spaced axially along the tubing and disposed at right-angles to the corrugation extension direction.

11. A material element according to claim 1 characterized in that the material body (10) has a constant layered thickness.

12. A material element according to claim 1 characterized in that, a flat rigid layer (3) extending perpendicular to the corrugation extension direction of said material body (10) and being rigid in comparison with the bending elasticity of the corrugated layers, is disposed along a portion of the circumference of said body.

13. A material element according to claim 12 characterized in that the rigid layer (3) is provided with a material weakness (30), in the form of a notch, extending in a direction parallel to the corrugation extension direction of the material body (10).

14. A material element according to claim 12 characterized in that the rigid layer (3) consists of a corrugated material portion with corrugations lying in a direction transverse to the corrugation extension direction of the material body (10).

15. A material element according to claim 1 characterized in that the corrugated material is corrugated cardboard, lined on one side.

16. A material element according to claim 1, characterized in that the corrugated material consists of recycled waste paper.

17. A material element according to claim 7, characterized in that the material body is a body that is separated from a continuously generated tubing of wound material.

18. A material element according to claim 8, characterized in that the material body is a body that is separated from a continuously generated tubing of wound material.

19. A material element according to claim 2, characterized in that the material body (10) has a constant layered thickness.

20. A material element according to claim 3, characterized in that the material body (10) has a constant layered thickness.

21. A material element according to claim 4, characterized in that the material body (10) has a constant layered thickness.

22. A material element according to claim 5, characterized in that the material body (10) has a constant layered thickness.

23. A material element according to claim 6, characterized in that the material body (10) has a constant layered thickness.

24. A material element according to claim 7, characterized in that the material body (10) has a constant layered thickness.

25. A material element according to claim 8, characterized in that the material body (10) has a constant layered thickness.

26. A material element according to claim 9, characterized in that the material body (10) has a constant layered thickness.

27. A material element according to claim 10, characterized in that the material body (10) has a constant layered thickness.

28. A material element according to claim 2, characterized in that a flat layer, extending perpendicular to the corrugation extension direction of said material body (10) and being rigid in comparison with the bending elasticity of the corrugated layers, is disposed along a portion of the circumference of said body.

29. A material element according to claim 3, characterized in that a flat layer, extending perpendicular to the corrugation extension direction of said material body (10) and being rigid in comparison with the bending elasticity of the corrugated layers, is disposed along a portion of the circumference of said body.

30. A material element according to claim 4, characterized in that a flat layer, extending perpendicular to the corrugation extension direction of said material body (10) and being rigid in comparison with the bending elasticity of the corrugated layers, is disposed along a portion of the circumference of said body.

31. A material element according to claim 5, characterized in that a flat layer, extending perpendicular to the corrugation extension direction of said material body (10) and being rigid in comparison with the bending elasticity of the corrugated layers, is disposed along a portion of the circumference of said body.

32. A material element according to claim 6, characterized in that a flat layer, extending perpendicular to the corrugation extension direction of said material body (10) and being rigid in comparison with the bending elasticity of the corrugated layers, is disposed along a portion of the circumference of said body.

33. A material element according to claim 7, characterized in that a flat layer, extending perpendicular to the corrugation extension direction of said material body (10) and being rigid in comparison with the bending elasticity of the corrugated layers, is disposed along a portion of the circumference of said body.

34. A material element according to claim 8, characterized in that a flat layer, extending perpendicular to the corrugation extension direction of said material body (10) and being rigid in comparison with the bending elasticity of the corrugated layers, is disposed along a portion of the circumference of said body.

35. A material element according to claim 9, characterized in that a flat layer, extending perpendicular to the corrugation extension direction of said material body (10) and being rigid in comparison with the bending elasticity of the corrugated layers, is disposed along a portion of the circumference of said body.

36. A material element according to claim 10, characterized in that a flat layer, extending perpendicular to the corrugation extension direction of said material body (10) and being rigid in comparison with the bending elasticity of the corrugated layers, is disposed along a portion of the circumference of said body.

37. A material element according to claim 11, characterized in that a flat layer, extending perpendicular to the corrugation extension direction of said material body (10) and being rigid in comparison with the bending elasticity of the corrugated layers, is disposed along a portion of the circumference of said body.

38. A material element according to claim 13, characterized in that the rigid layer (3) consists of a corrugated material portion with corrugations lying in a direction transverse to the corrugation extension direction of the material body (10).

39. A material element according to claim 2, characterized in that the corrugated material is corrugated cardboard, lined on one side.

40. A material element according to claim 3, characterized in that the corrugated material is corrugated cardboard, lined on one side.

41. A material element according to claim 4, characterized in that the corrugated material is corrugated cardboard, lined on one side.

42. A material element according to claim 5, characterized in that the corrugated material is corrugated cardboard, lined on one side.

43. A material element according to claim 6, characterized in that the corrugated material is corrugated cardboard, lined on one side.

44. A material element according to claim 7, characterized in that the corrugated material is corrugated cardboard, lined on one side.

45. A material element according to claim 8, characterized in that the corrugated material is corrugated cardboard, lined on one side.

46. A material element according to claim 9, characterized in that the corrugated material is corrugated cardboard, lined on one side.

47. A material element according to claim 10, characterized in that the corrugated material is corrugated cardboard, lined on one side.

48. A material element according to claim 11, characterized in that the corrugated material is corrugated cardboard, lined on one side.

49. A material element according to claim 12, characterized in that the corrugated material is corrugated cardboard, lined on one side.

50. A material element according to claim 13, characterized in that the corrugated material is corrugated cardboard, lined on one side.

51. A material element according to claim 14, characterized in that the corrugated material is corrugated cardboard, lined on one side.

52. A material element according to claim 2, characterized in that the corrugated material consists of recycled waste paper.

53. A material element according to claim 3, characterized in that the corrugated material consists of recycled waste paper.

54. A material element according to claim 4, characterized in that the corrugated material consists of recycled waste paper.

55. A material element according to claim 5, characterized in that the corrugated material consists of recycled waste paper.

56. A material element according to claim 6, characterized in that the corrugated material consists of recycled waste paper.

57. A material element according to claim 7, characterized in that the corrugated material consists of recycled waste paper.

58. A material element according to claim 8, characterized in that the corrugated material consists of recycled waste paper.

59. A material element according to claim 9, characterized in that the corrugated material consists of recycled waste paper.

60. A material element according to claim 10, characterized in that the corrugated material consists of recycled waste paper.

61. A material element according to claim 11, characterized in that the corrugated material consists of recycled waste paper.

62. A material element according to claim 12, characterized in that the corrugated material consists of recycled waste paper.

63. A material element according to claim 13, characterized in that the corrugated material consists of recycled waste paper.

64. A material element according to claim 14, characterized in that the corrugated material consists of recycled waste paper.

65. A material element according to claim 15, characterized in that the corrugated material consists of recycled waste paper.

66. A low-density material element (1) for use as protective packaging of packagable articles in a packaging container, consisting of a multi-layer body having a circular or oval shaped circumference and comprising a corrugated material, lined on one side with the corrugations of the layers extending in the same direction, and in which, in the direction of layering, the neighboring corrugated layers lie adjacent one another with a common lining layer (12), without interlocking with one another and without being compressed, the circumference of said body being several times its layering thickness (B) and which is held together with a singly positioned fixation, characterized in that the material body consists of a closed, circular shaped ring body (10), the interior circumference of said body being substantially larger than the ring width (13) determined by the layering thickness of at least two corrugated layers (11) lying loosely adjacent one another, wherein the ring body (10) is held together with said singly positioned fixation such that said neighboring corrugated layers (11) lying loosely adjacent one another are slidable relative to one another in directions perpendicular to the corrugation extension (S) so that the cross-sectional forms of said ring body (10) can be variably altered as desired by the user.

* * * * *